US005678422A

United States Patent [19]

Yoshii et al.

[11] Patent Number: 5,678,422

[45] Date of Patent: Oct. 21, 1997

[54] REFRIGERANT EVAPORATOR

[75] Inventors: Keiichi Yoshii; Masahiro Shimoya, both of Kariya, Japan

[73] Assignee: Nippondenso Co., Ltd., Kariya, Japan

[21] Appl. No.: 551,030

[22] Filed: Oct. 31, 1995

[30] Foreign Application Priority Data

Nov. 1, 1994 [JP] Japan ..... 6-268854

[51] Int. Cl.[6] ..... F28D 1/02; F25B 41/06

[52] U.S. Cl. ..... 62/513; 62/527; 165/153; 165/DIG. 465

[58] Field of Search ..... 165/153, DIG. 465, 165/467; 62/513, 515, 527

[56] References Cited

U.S. PATENT DOCUMENTS

| | | | |
|---|---|---|---|
| 4,589,265 | 5/1986 | Nozawa | 62/526 |
| 5,111,671 | 5/1992 | Kadle | 62/515 |
| 5,222,551 | 6/1993 | Hasegawa et al. | 165/167 |
| 5,245,843 | 9/1993 | Shimoya et al. | 62/515 |

FOREIGN PATENT DOCUMENTS

| | | | |
|---|---|---|---|
| 0 415 584 | 3/1991 | European Pat. Off. . | |
| 44 22 178 | 6/1994 | Germany . | |
| 4155194 | 5/1992 | Japan | 165/153 |

*Primary Examiner*—William E. Wayner
*Attorney, Agent, or Firm*—Cushman, Darby & Cushman IP Group of Pillsbury Madison & Sutro LLP

[57] ABSTRACT

A refrigerant evaporator 5 constructed by a refrigerant-refrigerant heat exchanger section 32 having an inflow passageway 38 and an outflow passageway 39, and a refrigerant-air heat exchanger section 34 having a bottom tank 48, a top tank 49 and evaporating passageways 100 connecting the tanks 48 and 49 with each other. An orifice 33 is arranged between the inflow passageway 38 of the refrigerant-air heat exchanger section 34 and the inlet tank 48 of the refrigerant-air heat exchanger section 34. The refrigerant in the bottom tank 48 is introduced into all of the evaporating passageways 100, so as to obtain a single, upward direction of flow of the refrigerant in the evaporating passageways 100.

3 Claims, 8 Drawing Sheets

REFRIGERANT EVAPORATOR

BACKGROUND OF THE INVENTION

1. Field of the Invention

The present invention relates to a refrigerant evaporator, wherein the flow of the refrigerant is divided into a plurality of refrigerant evaporating passageways. The present invention relates, more particularly, to an improvement of a type of refrigerant evaporator wherein a vaporized refrigerant is prevented from forming any superheated area at outlets of the refrigerant evaporating passageways, thereby improving the uniformity of the temperature distribution in a discharged air flow.

2. Description of Related Arts

In an air conditioning apparatus, there has been a long felt need that a temperature distribution as uniform as possible is obtained in an air flow discharged from an evaporator. In order to attain this, an evaporator is proposed, wherein an inlet tank is connected to a plurality of evaporating passageways, so that a flow of the refrigerant from the inlet tank downstream from an expansion valve is divided into a plurality of evaporating passageways, so that the refrigerant is uniformed distributed between the evaporating passageways. In this case, the refrigerant introduced, from the expansion valve, to the inlet tank is under a gaseous-liquid combined state, which makes it difficult for the refrigerant from the inlet tank to be uniformly distributed between the refrigerant passageways.

In view of this difficulty, a solution has heretofore provided wherein a pair of tanks are provided, between which a plurality of U-shaped passageways are, at their opposite ends, connected. Separators are arranged in the respective tanks so that the U-shaped passageways are divided into three groups and the number of the refrigerant passageways partitioned by the separators is reduced, so that a direction of the flow of the refrigerant is turned twice or triple, which allows the refrigerant to be evenly distributed to the U-shape passageway in one group of the refrigerant passageways, thereby obtaining a uniform distribution of the temperature of the discharged from the duct into the cabin.

However, in the prior art, the length of the refrigerating passageway from the inlet to the outlet is prolonged, on one hand, and the effective area of the refrigerating passageway is reduced, on the other hand, thereby increasing a pressure loss across the U-shaped passageway. Such an increase in the pressure loss causes the flow resistance to be increased, which causes an average value of the evaporating pressure of the refrigerant to be inevitably increased in the evaporating system, when a flow amount is maintained equal to that obtained by a refrigerant passageway of smaller pressure loss. Such an increase in the flow resistance causes the temperature of the refrigerant to be increased, which results in a reduction in a difference between the temperature of the air and the temperature of the refrigerant. As a result, a heat exchanging capacity is reduced, i.e., a cooling capacity of the air is reduced.

Furthermore, in order to prevent a liquid state compression occurring in a compressor, which, together with the refrigerant, constructs a refrigerating system, the evaporation of the refrigerant should complete its evaporation before the refrigerant is discharged from the outlet of the evaporator. In order to do this, it is usual that a superheating area is provided at the outlet of the refrigerant evaporator, where the refrigerant flowing in the evaporator is under a super heated vapor condition. However, an existence of such a superheated area at the outlet of the evaporating passageway causes a temperature variation to be increased between the inlet of the evaporating passageway and the outlet of the same, resulting in a variation in a heat exchanging efficiency of the refrigerant with respect to the air flow contacting the evaporator. Namely, the existence of the superheated area causes a difference to be generated between the temperature of the discharged air passed through a portion around the inlet of the refrigerant passageway and the temperature of the discharged air passed through the portion around outlet of the refrigerant passageway, so that the temperature distribution of the discharged air is likely to be uneven.

SUMMARY OF THE INVENTION

An object of the present invention is to provide a refrigerant evaporator capable of improving the distribution of the refrigerant by obtaining a pure liquid state of the refrigerant at the inlets of a plurality of the refrigerating passageways.

Another object of the present invention is to provide a refrigerant evaporator capable of improving a distribution of the air temperature by eliminating the superheated area at the outlet of the plurality of the refrigerating passageways.

Still another object of the present invention is to provide a refrigerant evaporator capable of preventing an occurrence of the liquid state compression by obtaining a superheated condition of the refrigerant which is discharged from the evaporator.

Further object of the present invention is to provide a refrigerant evaporator capable of preventing a reduction in a cooling ability by reducing the pressure at the plurality of the refrigerating passageways.

Further another object of the present invention is to provide a refrigerant evaporator capable of increasing a heat transfer performance between the refrigerant and the air by allowing the air flow to be directed from the bottom to the top in the plurality of the refrigerating passageways.

According to the present invention, an evaporator is provided, comprising:

a first heat exchanger for obtaining a heat exchange between a flow of a refrigerant and a flow of an air, and;

a second heat exchanger having an inflow passageway and an outflow passageway, which are arranged to obtain a heat exchange between a flow of the refrigerant in the inflow passageway and a flow of the refrigerant in the outflow passageway;

said first heat exchanger comprising an inlet tank connected to the inflow passageway for receiving the flow of the refrigerant therefrom, an outlet tank arranged above the inlet tank and connected to the outflow passageway for discharging the flow of the refrigerant therefrom and air-refrigerant heat exchanging means for defining a plurality of heat exchange passageways horizontally spaced in parallel, all of the heat exchanging passageways being, at their bottom ends, connected to the inlet tank and, at their top ends, to the outlet tank, thereby obtaining one way flow of the refrigerant in the heat exchange passageways from said bottom ends to said top ends.

BRIEF EXPLANATION OF ATTACHED DRAWINGS

DESCRIPTION OF A PREFERRED EMBODIMENT

Figure 1:
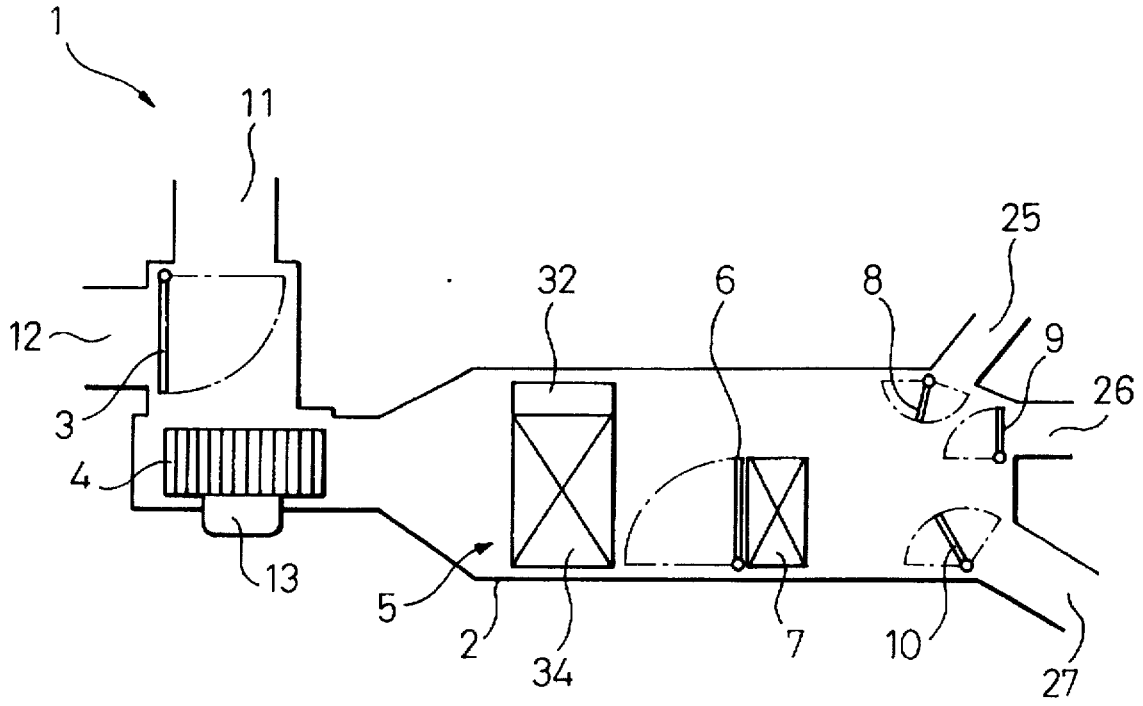
FIG. 1 is a schematic view of an air conditioning apparatus for an automobile.

Now, an embodiment of the present invention will be explained with reference to attached drawings, which shows an application of the present invention to an air conditioning apparatus for an automobile. In FIG. 1, a reference numeral 1 denotes an air conditioning apparatus, which includes a duct 2 having an upstream end for taking an outside air into the duct and a downstream end for discharging the air flow into a cabin of the automobile. At an upstream end of the duct 1, a switching damper 3 is located, which is connected to an actuator such as a servo-motor, so that the switching damper 4 is moved between a first position as shown by a solid line, where an air flow is introduced into the duct 2 from an outside air inlet 11, so that an atmospheric air is introduced into the duct 1, and a second position as shown by a phantom line, where an air flow is introduced into the duct 2 from an inside air inlet 11, so that an air from the cabin is introduced into the duct 1.

Downstream from the switching damper 3, a blower 4 is arranged in the duct 2. The blower 4 is connected to a blower motor 13, which generates the rotating movement applied to the blower 4.

Figure 2:
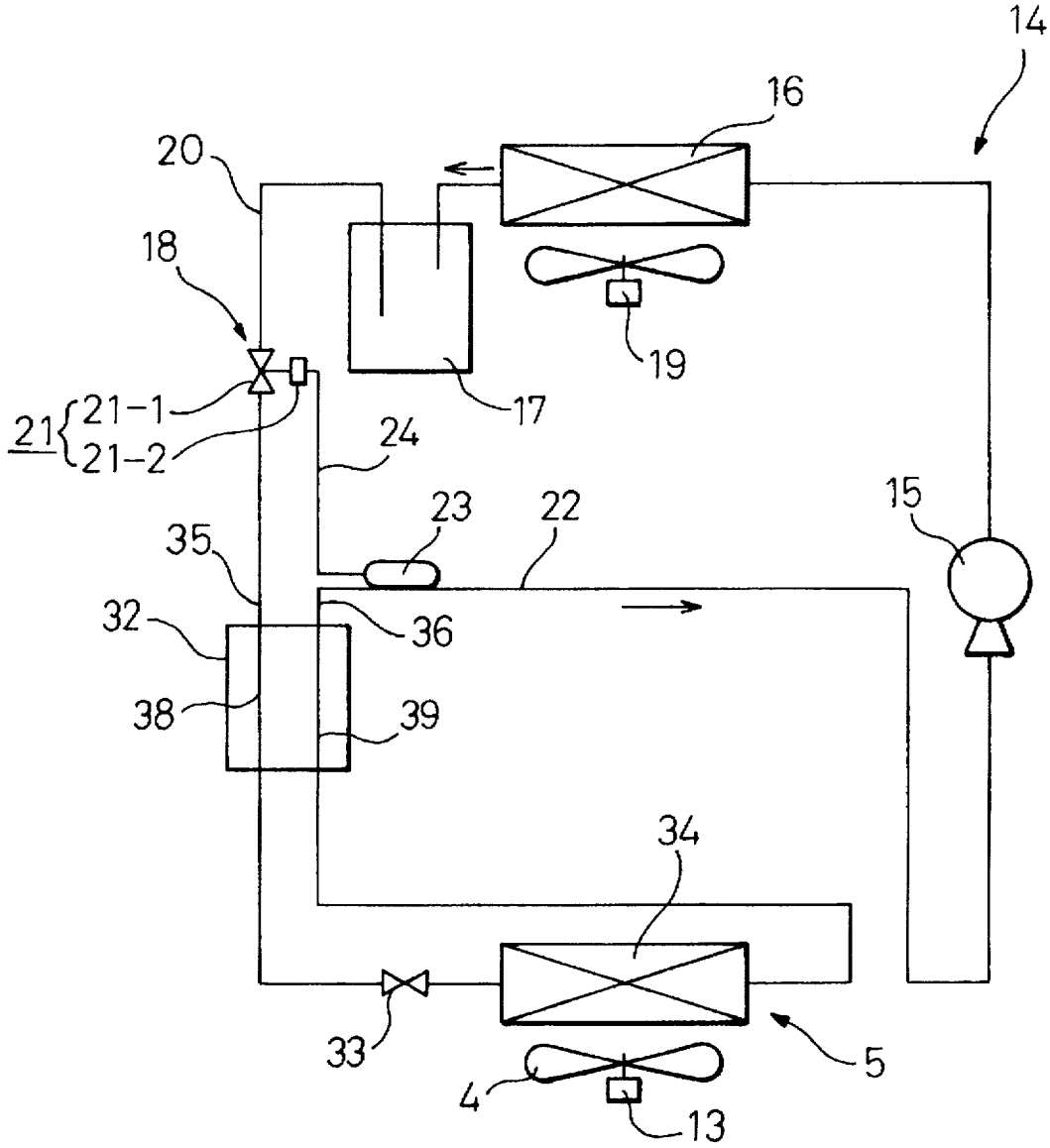
FIG. 2 is a schematic view of a refrigerating system in the air conditioning apparatus in FIG. 1.

A refrigerant evaporator 5 in a refrigerating system for executing a refrigerating cycle is arranged in the duct 2 at a position downstream from the blower 4. The refrigerant evaporator is constructed as a well known type including a plurality of stacked pipes. As shown in FIG. 2, the refrigerating system, which is generally shown by a reference numeral 14, includes, in addition to the evaporator 5, a compressor 15 for generating a flow of compressed refrigerant, a condenser 16 receiving the compressed refrigerant from the compressor 15, a receiver 16 at the outlet of the condenser 16 for separating a liquid phase of the refrigerant, and a temperature operated expansion valve 18 for reducing the pressure of the refrigerant introduced into the evaporator 34. The compressor 15 includes a rotating shaft, which is in a kinematic connection with a crankshaft of an internal combustion engine (not shown) by way of an electromagnetic clutch (not shown). As a result, an engagement of the electromagnetic clutch causes the rotating movement of the crankshaft to be transmitted to the rotating shaft of the compressor 15, thereby generating the flow of the compressed refrigerant.

In a well known manner, the compressed refrigerant at high pressure and temperature is condensed at the condenser 16, while a flow of an outside air generated by an outside cooling fan 19 is contacted with the condenser 16. As a result, a heat exchange is occurred between the flow of the outside air and the flow of the refrigerant, thereby cooling and liquidizing the refrigerant. The liquid phase refrigerant from the receiver is, at the expansion valve 18, subjected to an expansion so that the pressure of the refrigerant is reduced. The expansion valve 18 is provided with a temperature sensitive control mechanism for controlling the pressure reduction, i.e., an amount of a recirculated refrigerant for obtaining a constant degree of a superheat of the refrigerant an the outlet of the evaporator 5, so that evaporation of the refrigerant is completed before the refrigerant is issued from the outlet of the evaporator 5. Namely, the temperature sensitive control mechanism is constructed by a valve unit located in a refrigerant recirculating pipe 20 between the receiver 17 and the evaporator 5 and a temperature sensitive tube 23 which is arranged adjacent to a location of a refrigerant recirculating pipe 22 between the evaporator 5 and the compressor 15. In a well known manner, the valve unit 21 is constructed by a needle valve 21-1 and a diaphragm actuator 21-2, which is in communication with the temperature sensitive tube 23 via a capillary conduit 24.

In FIG. 1, an air mix damper 6 and a heater core 7 are arranged in the duct 2 at a location downstream from the evaporator 34. The heater core 6 has an inlet (not shown) for receiving a hot water from a cooling system (not shown) of the internal combustion engine and an outlet for returning the hot water to the engine cooling system. At the heater core, a heat exchange occurs between the engine hot water and an air flow in the duct 2. The air mix damper 6 is connected to a servomotor (not shown) and is moved between a closed position as shown by a solid line where the heater core 7 is closed by the air mix damper 6 and the air flow by-passes the heater core and an opened position as shown by a dotted line where the heater core 7 is opened so that the air flow can pass through the heater core. Furthermore, the air mix damper 6 can take a desired intermediate position between the closed position and opened position, so that a ratio between the amount of the air passed through the heater core 7 and the amount of the air by-passing the heater core 7, which ratio corresponds to the temperature of the discharged air, is desirably controlled.

At the downstream end, the duct 2 is formed with a defroster outlet 25 opened to a bottom of a windshield (not shown), an upper outlet 26 opened to an upper part of the cabin, and a lower outlet 27 opened to a lower part of the cabin. A defroster damper 8, an upper outlet damper 9 and a lower outlet damper 10 are provided for controlling the defroster outlet 25, the upper outlet 26 and the lower outlet 27, respectively. Servomotors are connected to the dampers 8, 9 and 10, respectively. Namely, the defroster damper 8, the upper outlet damper 9 and the lower outlet damper 10 are selectively operated such that a mode selection is executed between an upper outlet mode where a cold air flow is mainly discharged from the upper outlet 26 toward upper part of a driver or a passenger, a lower outlet mode where a hot air flow is mainly discharged from the lower outlet 27, a bi-level mode where a cold air flow is discharged from the upper outlet 26 and a hot air flow is discharged from the lower outlet 27, a lower-defroster outlet mode where a hot air flow is discharged from the defroster and upper outlets 25 and 26, and a defroster outlet where a hot air flow is discharged from the defroster outlet 25.

Figure 3:
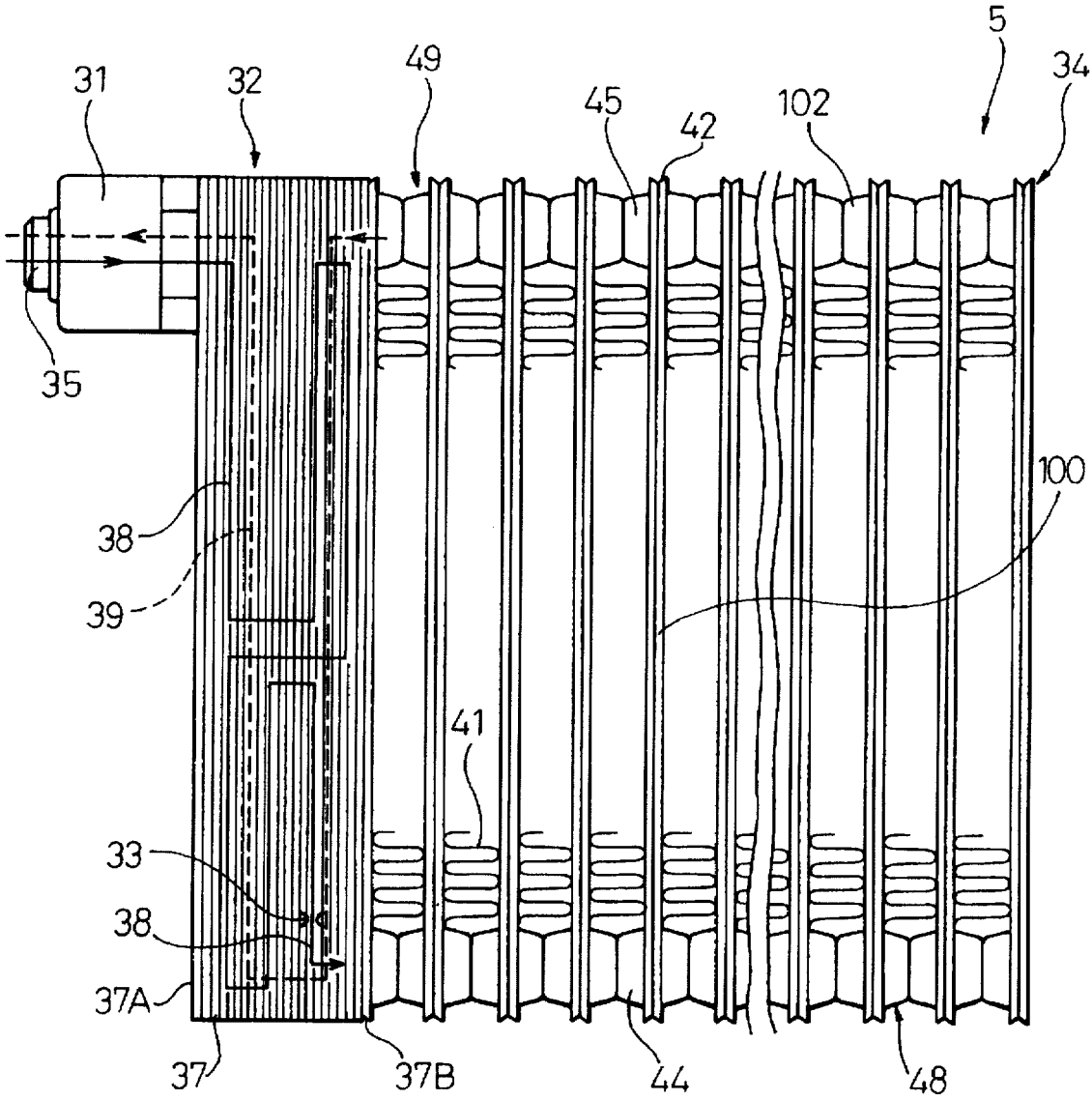
FIG. 3 is a front elevational view of an evaporator in the refrigerating system in FIG. 2.
Figure 4:
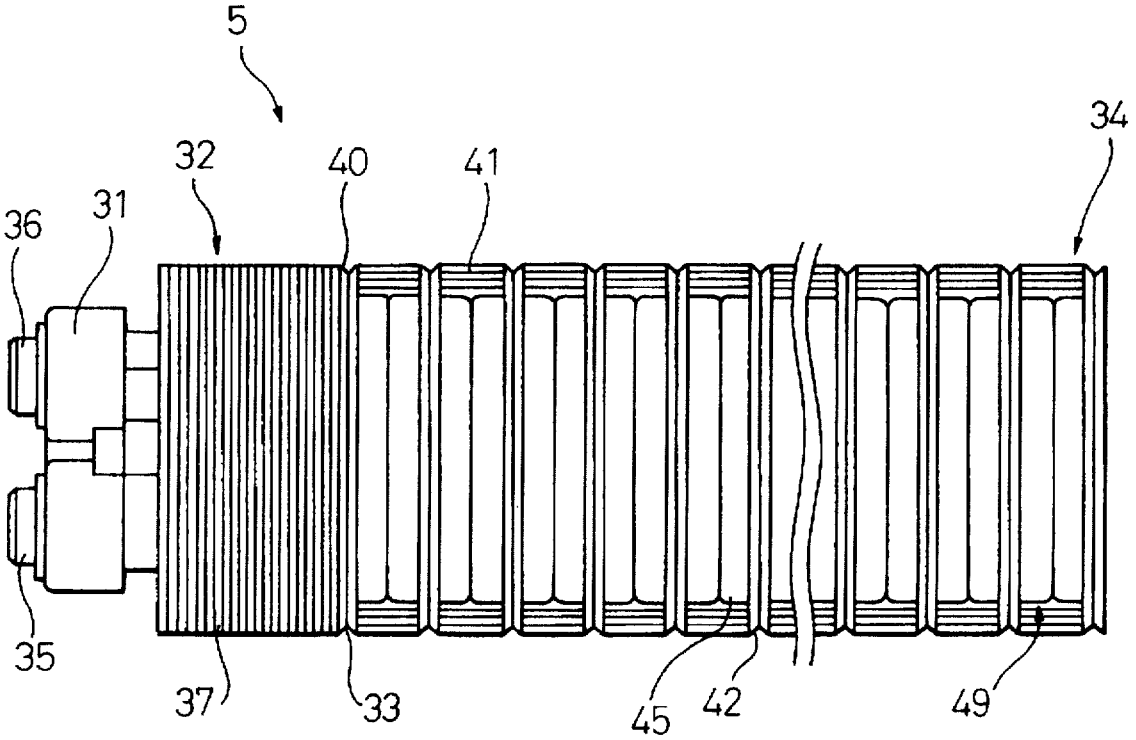
FIG. 4 is a top plan view of an evaporator in the refrigerating system in FIG. 2.

As shown in FIGS. 3 and 4, the evaporator 5 is basically constructed by a joint block 31, a refrigerant-refrigerant heat exchanger 32 and a refrigerant-air heat exchanger 34. The joint block 31 has an inlet conduit 35 for connecting the evaporator 5 to the pipe 20 to the valve body 21 of the temperature operated expansion valve 18 for allowing the liquid state refrigerant to be introduced into the evaporator 5 and has an outlet conduit 36 for connecting the evaporator 5 to the pipe 22 for allowing the gaseous state refrigerant to be returned to the compressor 15.

Figure 5:
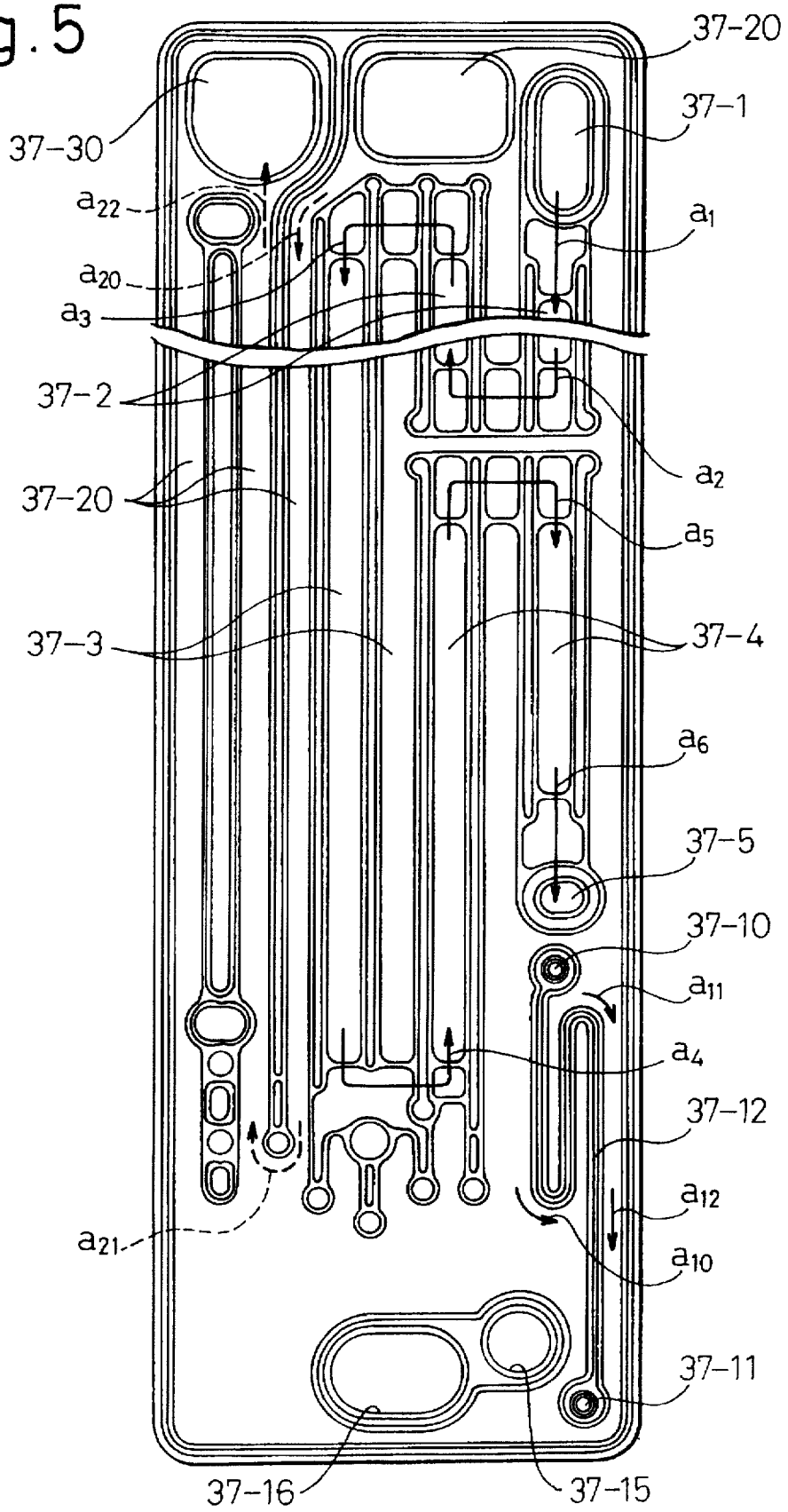
FIG. 5 is a front view of a heat exchanging plate of the refrigerant-refrigerant heat exchanging section of the evaporator.
Figure 7:
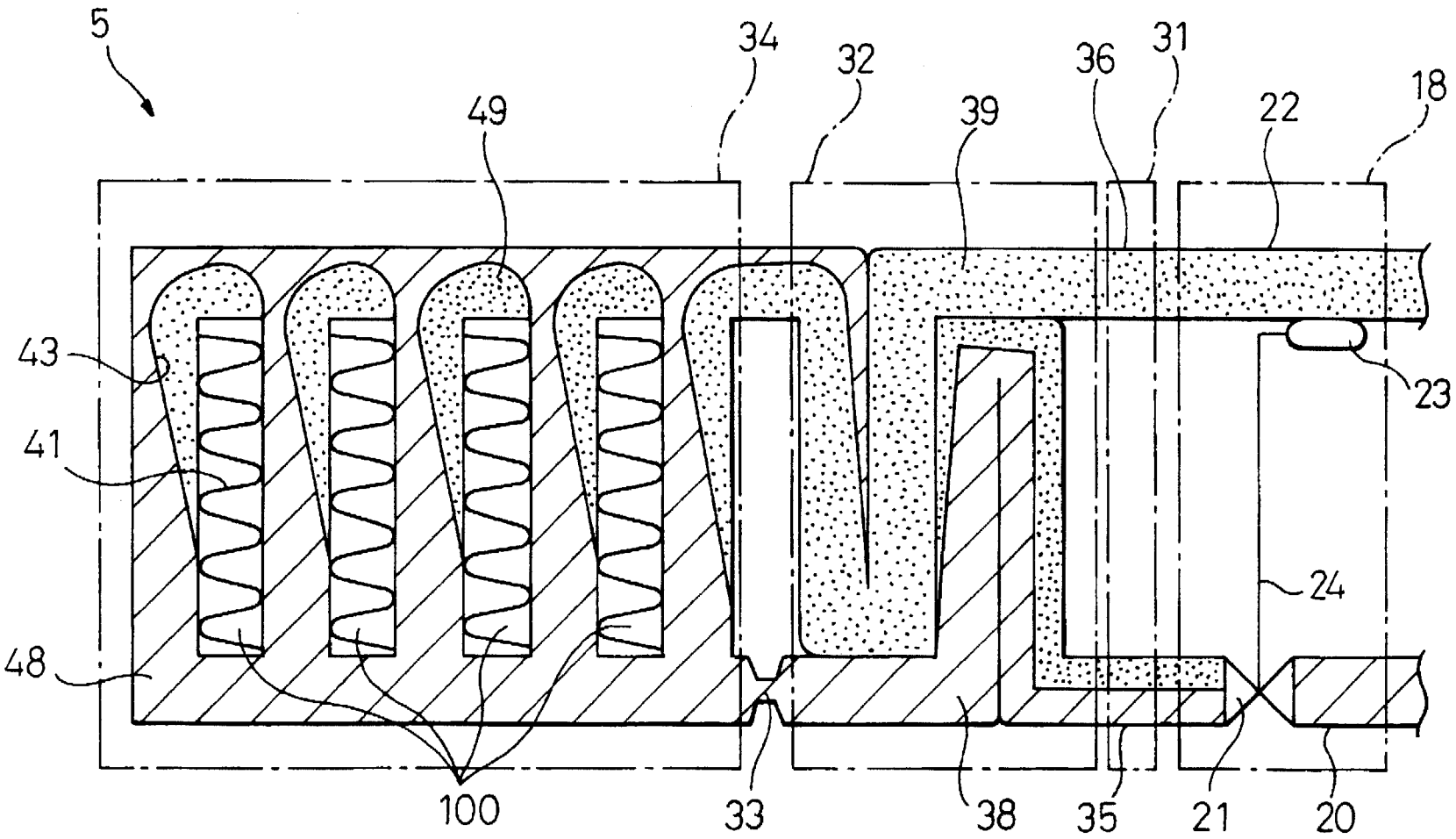
FIG. 7 is a schematic view of the evaporator in FIG. 3 for an illustration of an evaporating operation.

The refrigerant-refrigerant heat exchanger 32 is for obtaining a heat exchange between an inflow of the refrigerant to the refrigerant-air heat exchanger 34 and an outflow of the refrigerant from the refrigerant-air heat exchanger 34, so that the inflow of the refrigerant is liquidized and the outflow of the refrigerant is vaporized or superheated. The refrigerant-refrigerant heat exchanger 32 is constructed by a stack of heat exchanging plates 37 sandwiched between a front end plate 37A and a rear end plate 37B. As shown in FIG. 5, a heat exchanging plate 37 is formed as an elongated plate having an inlet opening 37-1 in communication with the inlet conduit 35, grooves 37-2 on one side of the plate 37 extending from a top end to a middle location, grooves 37-3 extending along the entire height, grooves 37-4 extending from a bottom end to a middle location, and an outlet opening 37-5 so as to construct an inflow passageway 38 (FIG. 3). As a result, an inflow of the refrigerant as shown by arrows $a_1$, $a_2$, $a_3$, $a_4$, as and $a_6$ is obtained. The flow from the opening 37-5 is moved toward the rear end plate 37B in FIG. 3, whereat the flow direction is reversed. The heat exchanging plate 37 has an opening 37-10 for receiving the reversed flow, a serpentine groove 37-12 of a small width, and an opening 37-11 for receiving the refrigerant from the groove 37-12. As a result, a serpentine flow of the refrigerant as shown by an arrow $a_{10}$, $a_{11}$ and $a_{12}$ is obtained. The grooves 37-12 of the exchanging plates 37 function as a capillary 33 (FIG. 7). The flow from the capillary is moved toward the front end plate 37A in FIG. 4, whereat the flow direction is reversed. The heat exchanging plate 37 has an openings 37-15 and 37-16 for receiving the reversed flow from the capillary. The opening 37-15 is, via an opening (not shown) in the rear end plate 37B, introduced into the refrigerant-air heat exchanger 34, the construction of which will be described later in detail. The refrigerant flows upwardly in the refrigerant-air heat exchanger 34 and is returned to the refrigerant-refrigerant heat exchanger 32 and a heat exchanging plate 37 has an opening 37-20 for receiving the returned flow. On the side opposite the side on which the groves 37-2 and 37-3 are formed, a heat exchanging plate 37 further has vertical grooves 37-20 along entire height, so as to construct an outflow passageway 39 (FIG. 3), so that a flow of the outflow of the refrigerant as shown by arrows $a_{20}$, $a_{21}$ and $a_{22}$ is obtained, so that a heat exchange is occurred between the inflow of the refrigerant on the first side of the plate 37 as shown by the arrows $a_1$, $a_2$, $a_3$, $a_4$, $a_5$ and $a_6$ and the outflow of the refrigerant as shown by the arrows $a_{20}$, $a_{21}$ and $a_{22}$. Finally the heat exchanging plate 37 has an opening 37-30 for receiving the outflow of the refrigerant, which is returned, via the conduit 36, to the pipe 22 and to the compressor 15.

Figure 6:
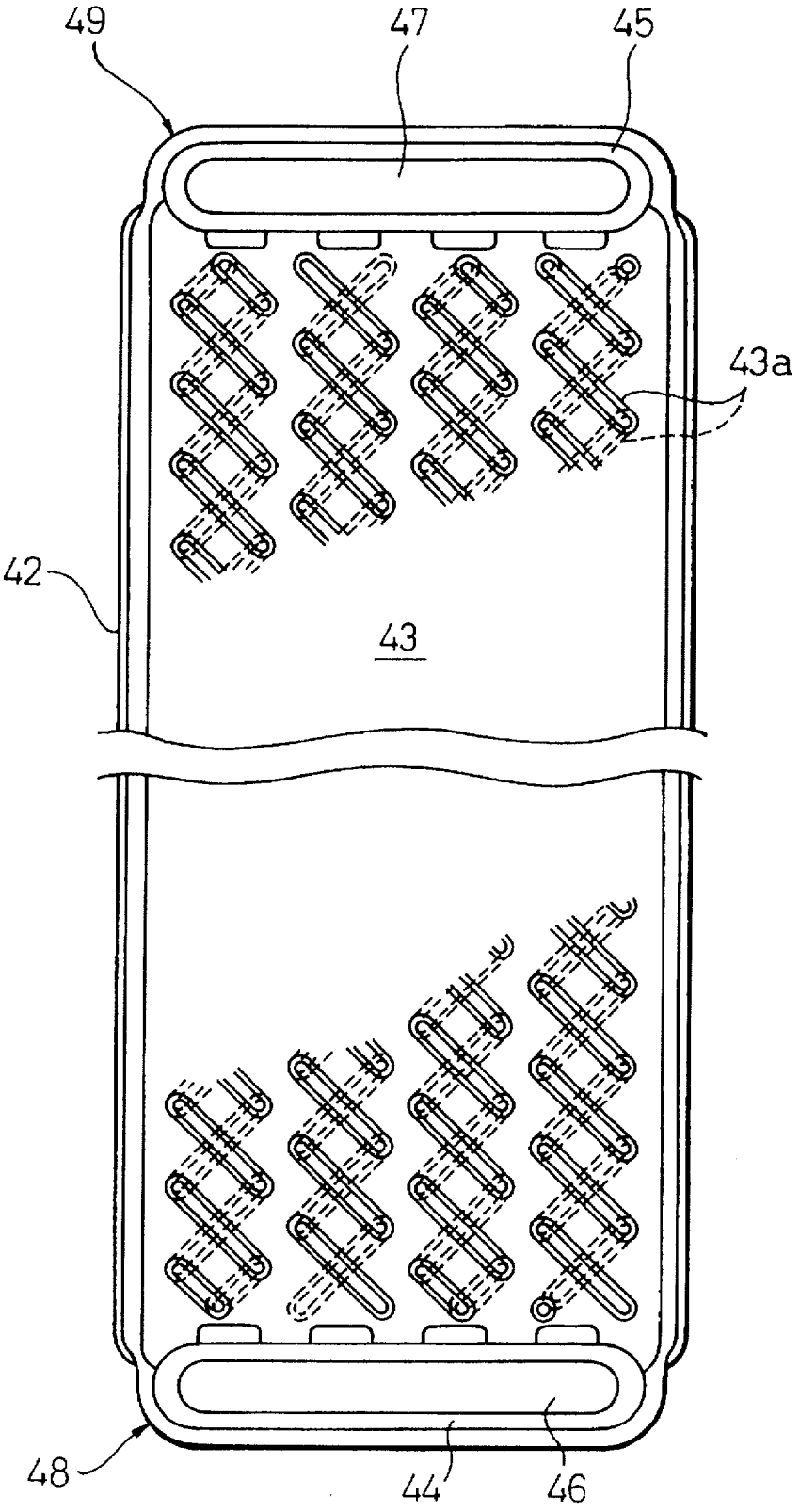
FIG. 6 is a front view of a heat exchanging plate of the air-refrigerant heat exchanging section of the evaporator.

As shown in FIG. 3, the refrigerant-air heat exchanger 34 is constructed as a stack of heat exchange plates 42 and corrugated fins 41 arranged between adjacent heat exchange plates 42. As shown in FIG. 6, on each of the heat exchange plates 42 is formed, on one side, a recessed portion 43, and is formed, on the other side, a bottom and top cup shaped portions 44 and 45. The cup shaped portions 44 and 45 extend along the entire width of the heat exchanging pipe 42 and form elongated openings 46 and 47. The heat exchange plates 42, which are adjacent with each other, are arranged so that the recessed portions 43 face each other, so that vertically extending refrigerant passageways 100 are created between the plates 42. The bottom cup shaped portions 44 in the stacked condition of the plates 42 are in a series arrangement so that a bottom (inlet) tank 48, which extends horizontally, is created. The top cup shaped portions 45 in the stacked condition of the plates 42 are in a series arrangement so that a top (outlet) tank 49, which extends horizontally, is created. The bottom tank 44 is in communication with the outlet openings 37-16 (FIG. 5), so that the refrigerant in the inflow passageway after the capillary 37-12 in the refrigerant-refrigerant heat exchanger 32 is introduced into the bottom tank 48. The refrigerant from the bottom tank 48 moves upwardly in the vertical passageways 100 and is introduced into the upper tank 49. The upper tank 48 is in communication with the openings 37-20 (FIG. 5), so that the refrigerant from the tank 48 is introduced into the outflow passageway in the refrigerant-refrigerant heat exchanger 32.

The refrigerant-air heat exchanger 34 functions to obtain a heat exchange between the refrigerant after it is passed through the capillary 37-12 and the air flow contacting with the heat exchanging plates 42 and the fins 41, so that the refrigerant is vaporized, while the air flow is cooled. These fins 41 and the heat exchanging plates 42 in the stacked condition are connected with each other by a brazing. The heat exchanging plates are made as a pressed work from a thin aluminum based alloy material. As shown in FIG. 6, the heat exchanging plate 42 is, at the recessed portion 43, formed with a plurality of inclined ribs **43*a* along the entire area of the portion 43, which is crossed with similar ribs as shown by dotted lines formed on the recessed portion 43 on the faced heat exchanging plate 42. The provision of ribs 43 allow the flow of the refrigerant at the vertical passageways 100** to be zigzagged, thereby increasing a heat exchanging capacity.

According to the present invention, the arrangement of the plurality of the horizontally spaced vertically extending heat exchanging passageways 100 of the refrigerant-air heat exchanger 34 is such that the flow of the refrigerant is only directed vertically from the bottom tank 49 to the top tank 49. In other words, the flow of the refrigerant is introduced into all of the passageways 100, while the flow is unidirectional from the bottom tank 49 to the top tank.

Now, an operation of the air conditioning apparatus according to the present invention will be explained. An energization of the clutch (not shown) causes the rotating movement of the crankshaft of the internal combustion engine to be transmitted to the compressor 15. As a result, compressed refrigerant from the compressor 15, at a high temperature and pressure, is introduced into the condenser 16. At the condenser 16, the refrigerant is contacted with the flow of the outside air by the fan 19, so that the refrigerant is cooled, thereby liquidizing the refrigerant. A phase separation occurs at the receiver 17, so that a liquidized refrigerant is introduced into the temperature controlled expansion valve 18, whereat the pressure of the refrigerant is reduced, thereby providing a gas-liquid combined state of the refrigerant. Then, the gas-liquid combined state refrigerant is introduced into the inflow passageway 38 of the refrigerant-refrigerant heat exchanger. The refrigerant flowing in the passageway 38 is subjected to a heat exchange with the refrigerant flowing in the passageway 39. FIG. 7 schematically illustrates the heat exchange operation between the passageways 38 and 39. Namely, in FIG. 7, the liquid the liquid phase of the refrigerant is represented by shaded lines, while the gaseous phase of the refrigerant is represented by an assembly of dots. The liquid state refrigerant is after being passed through the expansion valve, changed to the gas-liquid combined state. By the heat exchange between the passageways 38 and 39, the refrigerant in the passageway 38 is cooled and is changed into the liquid state.

The liquid state refrigerant is subjected to the pressure reduction when passed through the capillary 33, and is introduced into the bottom tank 48 of the refrigerant-gas heat exchanger 34 in the liquid state. The refrigerant in the bottom tank 48 is evenly distributed to all of the refrigerant passageways 43 connected to the bottom tank 48, and is moved upwardly toward the top tank 49 without turning the direction of the flow. When the refrigerant passes through the refrigerant passageways 43, a heat exchange occurs with respect to the air flow in the duct 2 of the air conditioning apparatus, so that the refrigerant is vaporized. As a result of the heat exchange with the evaporated refrigerant at the passageways 43, the air contacting therewith in the duct 2 is cooled, and is discharged into the cabin from a selected outlet, such as the top outlet 26. In this embodiment of the present invention, the refrigerant should be under a super-heated condition to a desired degree of the superheat at the outflow passageway 39 of the refrigerant-refrigerant heat exchanger 32. In other words, the refrigerant at the refrigerant passageways 43 of the refrigerant-air heat exchanger 34 is in a partially liquidized state.

The refrigerant flows issued from the respective refrigerant passageways 43 are combined at the outlet tank 49 and are discharged into the outflow passageway 39 of the refrigerant-gas heat exchanger. Due to the heat exchange with the refrigerant in the inflow passageway 38, the refrigerant in the outflow passageway 39 is heated, so that a value of the degree of the superheating of the refrigerant in the outflow passageway 39 is larger than 1.0, thereby obtaining a superheated refrigerant before it is supplied to the compressor 15.

Figure 8:
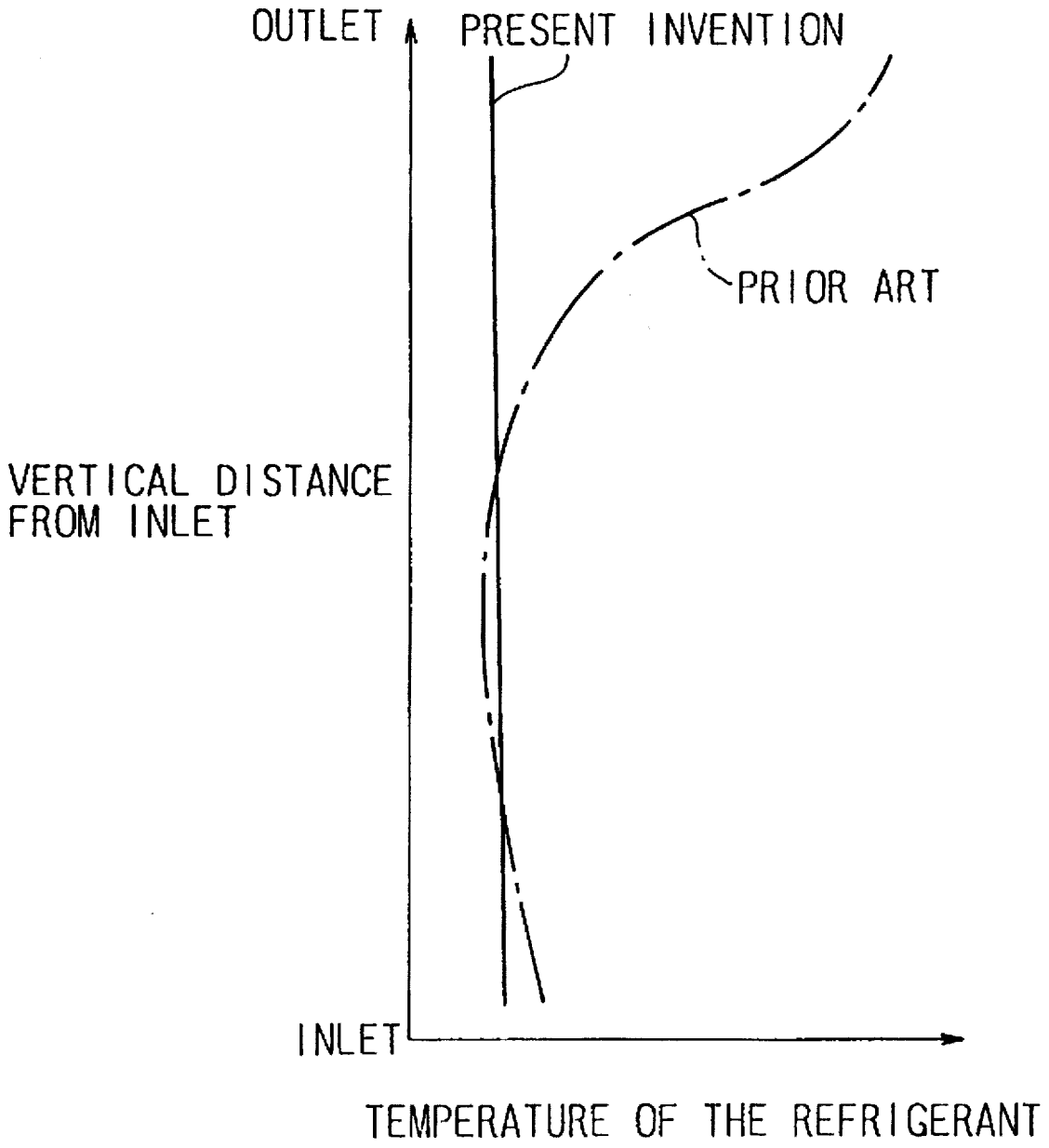
FIG. 8 is relationships between a temperature of the refrigerant and a vertical position of a refrigerating passageway from its inlet.

As explained above, in the air conditioning apparatus 1 for a vehicle according to the present invention, the fixed orifice (capillary) 33 constructed by the grooves 37-12 is provided, so that the refrigerant from the inflow passageways 38 is, under a gas-liquid combined state, introduced into the inlet (bottom) tank 48 and the inflow passageways 38, of the refrigerant-air heat exchanger. The gas-liquid combined state in the inlet tank 48 allows the refrigerant to be evenly distributed to all of the refrigerant passageways 100. In other words, the construction according to the present invention does not cause the distribution of the refrigerant to be uneven between the refrigerant passageways 100. Furthermore, according to the present invention, the refrigerant at the outlet of the refrigerant passageways 100 is prevented from becoming superheated. Rather, the superheated condition of the refrigerant (value of the degree of the overheating larger than 1.0) is obtained at an outlet of the outflow passageway 39 of the refrigerant-refrigerant heat exchanger 32. As a result, an effective heat exchange of the refrigerant with respect to the air is obtained. In FIG. 8, a solid line shows a relationship between the temperature of the refrigerant and a distance of a refrigerant evaporating passageway 100 from its inlet in a direction of the flow of the refrigerant in the embodiment of the present invention. As will be easily seen, a substantially uniformed temperature is obtained along the entire length from the inlet to the outlet of the refrigerant evaporating passageway 100. In particular, an increased in the temperature of the refrigerant at the outlet of the refrigerant evaporating passageway 100 is prevented, thereby obtaining a uniform heat exchanging capacity, i.e., a cooling performance of the stacked type of the evaporator 5 along its entire area.

In view of the above, a uniform distribution of the temperature of the discharged air after contacted with the plurality of refrigerant evaporating passageways 100 is obtained not only along the entire width of the refrigerant-air heat exchanger 34, i.e. in the direction parallel to the arrangement of the plurality of refrigerant evaporating passageway 100 but also along the entire height of the refrigerant-air heat exchanger 34, i.e., in the vertical direction.

Furthermore, a flow of the refrigerant in each of the refrigerant evaporating passageways 100 is obtained from its bottom portion to its top portion against the force of the gravity. As a result, a well mixed state is obtained between a liquid phase of the refrigerant likely to be located mainly at a core portion of the refrigerant evaporating passageway 100 and a gaseous phase of the refrigerant likely to be located at a peripheral portion of the refrigerant evaporating passageway 100. As a result, a quick movement of the liquid phase of the refrigerant toward the inner side of the refrigerant pipe at a relatively high temperature is obtained, which allows the refrigerant to be effectively subjected to a heat exchange with respect to the air flow contacting the outer wall of the pipe. In other words, an improved heat exchange capacity is obtained according to the present invention over a prior art construction where the refrigerant flows in the heat exchange pipe from its top portion to its bottom portion.

According to the present invention, in the refrigerant-refrigerant heat exchanger 32, the direction of the flow of the refrigerant in the inflow passageway 38 and the direction of the flow of the refrigerant in the outflow passageway 39 are opposite to each other, which allows the heat exchanging efficiency to be improved between the inflow refrigerant and the outflow refrigerant in the refrigerant-refrigerant heat exchanger 32. As a result, a super-heated condition of a value of the degree of the superheating of the refrigerant larger than 1.0 is obtained at the outlet of the stacked type heat exchanger 5. As a result, the refrigerant is prevented from being introduced in a liquid state, which otherwise would cause a liquid compression, thereby preventing the compressor from being damaged.

Furthermore, according to the present invention, the refrigerant at the inlet (bottom) tank 48 is introduced, via all of the refrigerant evaporating passageways 100, into the outlet (upper) tank 49 while the direction of the flow of the refrigerant is unchanged, thereby reducing a pressure loss at the evaporating passageways 100 while reducing an average value of the evaporating pressure of the refrigerant at the stacked refrigerant evaporator 5. Due to the reduction in the evaporating temperature, an increased temperature difference is obtained between the refrigerant flowing in the plurality of the refrigerant passageways 100 and the air contacting with the outer wall of the heat exchanging pipes, thereby enhancing a heat exchanging capacity at the stacked heat exchanger 5, i.e., the air cooling capacity. According to a test by the inventor, it was found that an increase in 12% in the cooling capacity is obtained by the construction of the present invention over the prior art structure where the direction of the flow is turned triple.

The embodiment as explained above is directed to an application of an idea of the present invention to a stacked type evaporator for a refrigerating system in an air conditioning apparatus for an automobile. However, the present invention can be applied to other fields such as an air conditioning apparatus for a building.

Furthermore, in place of the stacked type of evaporator, other type of evaporator can be used, such as that includes a serpentine circular tube with plate fins or a tube of a different cross sectional shape with corrugated fins.

Furthermore, in the shown embodiment, only one fixed throttle 33 is arranged between the inflow passageway 38 of the refrigerant-refrigerant heat exchanger section 32 and the evaporating passageways 100 of the refrigerant-air heat exchanger section 34. However, a plurality of such orifices can be provided. Furthermore, in place of the orifice of the fixed type as shown, a variable type of orifice can be employed.

Finally, in the shown embodiment, the refrigerating system is of a receiver cycle type including the receiver 17. However, an accumulator cycle type of refrigerating system can also be employed. Furthermore, in place of a temperature operated expansion valve, a fixed type expansion valve such as a capillary tube or an orifice can be employed.

We claim:

1. An evaporator comprising:

a first heat exchanger for obtaining a heat exchange between a flow of a refrigerant and a flow of an air, and;

a second heat exchanger having an inflow passageway and an outflow passageway, which are arranged to obtain a heat exchange between a flow of the refrigerant in the inflow passageway and a flow of the refrigerant in the outflow passageway;

said first heat exchanger comprising an inlet tank connected to the inflow passageway for receiving the flow of the refrigerant therefrom, an outlet tank arranged above the inlet tank and connected to the outflow passageway for discharging the flow of the refrigerant therefrom and air-refrigerant heat exchanging means for defining a plurality of heat exchange passageways horizontally spaced in parallel, all of the heat exchanging passageways being, at their bottom ends, connected to the inlet tank and, at their top ends, to the outlet tank, thereby obtaining one way flow of the refrigerant in the heat exchange passageways from said bottom ends to said top ends.

2. An evaporator according to claim 1, wherein said air-refrigerant heat exchanging means comprises a plurality of horizontally spaced heat exchanging units, each of which is constructed by a pair of heat exchanging plates;

each of plates having a recess on one side and top and bottom cup shaped projections;

the heat exchanging plates in each pair being arranged in such a manner than the recesses are arranged to be faced with each other thereby forming a heat exchanging passageway therebetween;

the heat exchanging units, which are adjacent with each other, being arranged in such a manner that the bottom and top cup shaped portions are in communication with each other so that the bottom, inlet tank and the top, outlet tank are respectively formed.

3. An evaporator comprising:

a first heat exchanger for obtaining a heat exchange between a flow of a refrigerant and a flow of an air; and a second heat exchanger having an inflow passageway and an outflow passageway, which are arranged to obtain a heat exchange between a flow of the refrigerant in the inflow passageway and a flow of the refrigerant in the outflow passageway;

said first heat exchanger comprising an inlet tank connected to the inflow passageway for receiving the flow of the refrigerant therefrom, an outlet tank arranged above the inlet tank and connected to the outflow passageway for discharging the flow of the refrigerant therefrom and air-refrigerant heat exchanging means for defining a plurality of heat exchange passageways horizontally spaced in parallel, all of the heat exchanging passageways being, at their bottom ends, connected to the inlet tank and, at their top ends, to the outlet tank, thereby obtaining one way flow of the refrigerant in the heat exchange passageways from said bottom ends to said top ends, wherein it further comprises an orifice arranged in the inflow passageway of the second heat exchanger at a location downstream of the inflow passageway adjacent to the inlet tank.

* * * * *